US006854953B2

(12) United States Patent
Van Drentham-Susman et al.

(10) Patent No.: US 6,854,953 B2
(45) Date of Patent: Feb. 15, 2005

(54) SPEED GOVERNOR

(75) Inventors: Hector F. A. Van Drentham-Susman, Inverurie (GB); Kenneth Roderick Stewart, Blairs (GB); Richard D. Neilson, Bridge of Don (GB); Donald Stewart, Munlochy (GB); Gary L. Harris, Humble, TX (US)

(73) Assignee: Rotech Holdings, Limited, Aberdeen (GB)

( * ) Notice: Subject to any disclaimer, the term of this patent is extended or adjusted under 35 U.S.C. 154(b) by 49 days.

(21) Appl. No.: 10/212,584

(22) Filed: Aug. 5, 2002

(65) Prior Publication Data

US 2003/0029308 A1 Feb. 13, 2003

Related U.S. Application Data

(63) Continuation-in-part of application No. PCT/GB01/05350, filed on Dec. 4, 2001.

(30) Foreign Application Priority Data

Dec. 4, 2000 (GB) ..... 0029531

(51) Int. Cl.[7] ..... F04D 15/00
(52) U.S. Cl. ..... 415/36; 175/107
(58) Field of Search ..... 175/107, 324; 415/13, 25, 30, 36, 42, 43

(56) References Cited

U.S. PATENT DOCUMENTS

| | | | | |
|---|---|---|---|---|
| 2,207,340 A | | 7/1940 | Claus | |
| 2,879,032 A | | 3/1959 | Whittle | |
| 2,963,099 A | | 12/1960 | Gianelloni, Jr. | |
| 3,749,185 A | * | 7/1973 | Tiraspolsky et al. | 175/26 |
| 3,802,515 A | | 4/1974 | Flamand | |
| 4,768,598 A | * | 9/1988 | Reinhardt | 175/107 |
| 4,776,752 A | | 10/1988 | Davis | |

FOREIGN PATENT DOCUMENTS

| | | |
|---|---|---|
| EP | 0 305 511 | 9/1988 |
| GB | 755207 | 8/1956 |

* cited by examiner

*Primary Examiner*—Edward K. Look
*Assistant Examiner*—Richard A. Edgar
(74) *Attorney, Agent, or Firm*—John R. Casperson

(57) ABSTRACT

The present invention provides a speed governor (5) suitable for use in a fluid driven down-hole tool (3). The speed governor comprises an actuator (7) operatively coupled to a motive fluid flow control valve (6). The actuator is and arranged so as to be activatable, directly or indirectly, in response to the running speed of the tool (3), for opening of the control valve (6) with increasing rotational speed of the motor (3) above a predetermined speed limit thereby to limit the rotational speed of the downhole tool (3).

29 Claims, 9 Drawing Sheets

SPEED GOVERNOR

This application is a continuation-in-part of PCT/GB01/05350 filed Dec. 4, 2001.

CROSS REFERENCES TO RELATED APPLICATIONS

This application is a continuation in part of and claims the benefit of copending U.S. application Serial No. PCT/GB01/05350 titled "Speed Governor" which designated the United States and had an international filing date of 4 Dec. 2001. No Demand was filed. Application Ser. No. PCT/GB01/05350 had an international publication number of WO 02/46565, an international publication date of 13 Jun. 2002, and claims a priority date of 4 Dec. 2000 from GB 0029531.1. The disclosures of these earlier applications are incorporated by reference herein.

BACKGROUND OF THE INVENTION

The present invention relates to speed governors suitable for use in controlling the speed of high speed turbines and other fluid driven motors, and especially those used in down-hole drilling applications and the like.

It is a particular problem with down-hole drilling that the material being drilled through can be subject to frequent and/or large changes in hardness and/or other properties resulting in significant changes in drilling resistance. When there is a more or less sudden reduction in drilling resistance, which is especially large when the drilling bit lifts off from the bottom of the borehole for any reason, there is a tendency for the motor to speed up veiy quickly and dramatically—typically in as little as 20 to 100 milliseconds. In the past, prevention of such over-speeding has been attempted by very careful control of the drilling operation to try to minimize any possible lift off, and/or to use braking systems such as eddy current brakes. Conventional speed governors are generally of the centrifugal clutch type in which weights are forced radially outwardly against a spring resistances. An increase in speed increases the centrifugal forces acting on the weights and forces a brake shoe against a brake drum. In the case of both such conventional speed governors and eddy current brakes there is however a significant loss in efficiency since they apply some degree of braking at all times. Furthermore when increased braking is applied, the flow of motive fluid through the motor or turbine is significantly reduced thereby building up fluid pressure behind the turbine.

It is an object of the present invention to avoid or minimize one or more of the above disadvantages or problems.

SUMMARY OF THE INVENTION

It has now been found that over-speeding can be controlled in a particularly convenient and efficient manner by providing a speed governor comprising a motive fluid control valve operated by a speed responsive actuator.

Thus the present invention provides a speed governor suitable for use with a fluid driven downhole tool wherein said speed governor comprises an actuator operatively coupled to a motive fluid flow control valve, said actuator being formed and arranged so as to be activatable, directly or indirectly, in response to the running speed of the tool in use of said speed governor.

In one form of the invention the actuator is formed and arranged so as to be activatable in response to the motive fluid flow rate through the drive of said downhole tool.

In another form of the invention the actuator is formed and arranged so as to be activatable in response to the rotational speed of a rotating component of said downhole tool.

Conveniently the actuator comprises a pressurized fluid circuit having a pump driven by at least part of said motive fluid flow or, directly or indirectly, by said rotating component, respectively, and a displacement member displaceable in response to fluid pressure in said pressurized fluid circuit, against the return force of a resilient biasing device. Thus for example the pump may be driven by a small fluid motor or turbine connected in series with at least part of the motive fluid flow driving the downhole hole tool, changes in the rotational speed of the tool being reflected in changes in the motive fluid flow rate driving it.

Alternatively the pump may be mechanically drivingly connected, to a rotating component of the downhole tool such as a rotor.

Advantageously there is used an actuator which has at least one first displacement member, formed and arranged so as to be displaceable radially outwardly under the influence of centrifugal forces, directly or indirectly against the return force of a resilient biasing device.

Preferably said at least one first displacement member is drivingly coupled to at least one second displacement member for axial displacement of said at least one second displacement member by said at least one first displacement member. Most preferably said at least one first displacement member comprises a discrete mass element such as a ball in camming inter-engagement with opposed cam surfaces provided on at least one of a respective said at least one second displacement member and a member opposed thereto so as to convert the radially outward movement of the first displacement member into said axial displacement of said at least one second displacement member. It will be understood here that either or both of the cam surfaces may have an axial component i.e. extend at an angle to the directly radially outward direction.

Preferably the actuator comprises a housing mounting a first support member and a second support member displaceable relative to said first support member, said first and second support members being provided with opposed cam surfaces and with resilient biasing means formed and arranged for biasing said support members with said cam surfaces towards each other, and at least one discrete mass element supported between said cam surfaces in engagement therewith, said cam surfaces converging towards each other in a radially outward direction so that forcing together of said first and second members by said biasing means urges said at least one mass element radially inwardly, whereby when said actuator is subjected to increasing rotational speed, in use thereof, said at least one mass element is subjected to increased centrifugal forces which tend to drive said first and second support members away from each other.

In a further preferred aspect the present invention provides a speed governor suitable for use in a fluid driven down-hole motor which has a rotor, for controlling motive fluid supply to said motor by means of a motive fluid dump valve, said governor comprising an actuator for said dump valve which actuator is formed and arranged for driven coupling to said motor rotor in use of the governor, said actuator comprising a housing mounting a first support member and a second support member displaceable relative to said first support member, said first and second support members being provided with opposed cam surfaces and with resilient biasing means formed and arranged for biasing said support members with said cam surfaces towards each other, and at least one discrete mass element supported between said cam surfaces in engagement therewith, said cam surfaces converging towards each other in a radially outward direction so that forcing together of said first and second members by said biasing means urges said at least one mass element radially inwardly, whereby when said actuator is subjected to increasing rotational speed, in use thereof, said at least one mass element is subjected to increased centrifugal forces which tend to drive said first and second support members away from each other, said second support member being coupled to said dump valve for opening thereof when said second support member is driven away from said first support member by said mass element with increasing rotational speed of the motor above a predetermined speed limit.

The governor of the present invention prevents overspeeding of the motor to which it is coupled by opening the motive fluid dump valve or other control valve thereby diverting at least part of the motive fluid supply flow away from the motor, thereby reducing the driving force applied to the motor by the motive fluid. Where the control valve is a bypass valve (diverting motive fluid flow internally around the downhole tool drive), this has the advantage of maintaining fluid flow to a tool such as a bit thereby permitting continued removal of cuttings. Flow restriction control valves are particularly advantageous where the motive fluid is a gas, since this substantially avoids loss of pressure therein which would result with dumping, the latter being a significant problem due to the time required to build pressure back up again in a downhole situation. Those embodiments using discrete mass elements with a particularly simple form of support therefor, have the further advantage of avoiding linkages and levers to support and control movement of, the mass elements subjected to centrifugal forces to operate the governor, thereby providing particular benefits in terms of increased reliability as a result of the reduced number of moving parts and the simple nature of the interaction between the moving parts. This simple form of construction also has the further advantage of reduced susceptibility to jamming or blockages caused by solids present in the motive fluid, which is often the case in down-hole applications where motive fluids such as drilling mud are employed.

It will be appreciated that the opposed cam surfaces and discrete mass element(s) may have various different geometries without departing from the scope of the present invention. In general it is preferred to employ a plurality of discrete mass elements which are maintained in a substantially symmetrically, angularly distributed arrangement, around a central rotational axis of the actuator, in order to provide a substantially balanced rotation thereof in use of the governor. Advantageously therefore, the cam surfaces are provided in the form of elongate, generally radially extending recesses of progressively reducing depth in a radially outward direction. The recesses may extend substantially directly radially outwardly or could extend in a generally spiral manner, preferably each with a generally limited angular extent, for example, from 10 to 120 degrees, conveniently from 30 to 90 degrees. It will also be appreciated that the cam surfaces could be substantially symmetrical, i.e., mirror images, or different, i.e., with different slopes in the radially outward direction, e.g., one could simply be orthogonal to the rotational axis.

The discrete mass elements may have any convenient shape suitable for easy traversing of the cam surfaces, e.g., by rolling therealong, in a generally radial direction. Most conveniently the mass elements are in the form of spherical balls, in which case the cam surfaces are preferably in the form of part-circular section channels of progressively reducing depth (albeit substantially constant radius corresponding substantially to that of the balls). Desirably at least 3, conveniently from 4 to 8, for example 6, discrete mass elements are employed.

In view of the loadings to which the cam surfaces and balls are subjected, these are desirably made of relatively hard and durable materials such as tungsten carbide or suitable steel alloys such as S2 tool steel, 8620 carburising steel or other carbon/manganese carburising steels. It will moreover be understood that increased displacement forces and/or rates of displacement eta may be obtained by using higher mass and/or higher density discrete mass elements.

It will also be appreciated that the opening of the dump valve or other control valve will depend on the relationship between the forces exerted by the mass elements on the cam surfaces and the biasing forces exerted by the resilient biasing means.

In general the latter will be pre-loaded to a suitable degree to ensure that the second support member is not displaced below a predetermined rotational speed of the motor, generally at least 800 rpm, and typically 1000 rpm for a positive displacement motor or generally at least 10,000 rpm, and typically 12,000 to 13,000 rpm for the turbine. It will be appreciated that various different resilient biasing mechanism arrangements can be used. Thus on the one hand there may be used a relatively soft spring with a relatively high pre loading which would tend to provide a relatively rapid dump valve or other control valve opening when the threshold speed has been reached resulting in a rapid braking effect. On the other hand there may be used a stiffer spring which would tend to provide a slower more gradual dump valve or other control valve opening when the predetermined rotor threshold speed has been reached resulting in a more gradual braking effect, and a generally smoother variation in rotor speed. Where it is desired to provide a substantially progressive opening of the dump valve or other control valve, e.g., between a fully closed and a filly open condition thereof, in order to provide a variable rate of motive fluid dumping with increasing rotational speed above a predetermined limit, for example, from 1,000 to 1,100 rpm for a positive displacement motor, or from 15,500 to 13,500 rpm for a turbine, then this can be achieved by selection of a suitable, non-linear, spring rate for the resilient biasing means or device, in well known manner. Preferably there is used a spring rate for providing a progressive actuator displacement to provide a progressive opening of the dump valve or other control valve between fully closed and fully open positions thereof over a rotor speed range which is from 5 to 20% of the threshold rotor speed, most preferably about 10% of the threshold rotor speed.

The most suitable form of resilient biasing device in any given case will depend on, inter alia, the requirements of the motor application concerned, such as the expected range of motor speed variation, the required braking response speed etc. and can be selected in generally known manner and/or by means of trial and error.

It is also possible to modify the opening and closing rate of the dump valve or other control valve relative to change in rotational speed of the motor or turbine, by means of modifying the shape of the cam surface profile, it being also understood that since the centrifugal force on the balls is proportional to the square of the angular velocity, the outward travel of the balls is also proportional to the square of the angular velocity. Thus the cam surface profile (along which the mass element travels) may be comprised of one or more portions each of which may be rectilinear, concave, or convex. Any concave or convex curved cam surface profile portion may moreover be part-circular or part-elliptic, or any other suitably curved profile. There may also be used cam surface profile portions at various different angles to the directly radially outward direction. In general it will be appreciated that the steeper the cam surface profile angle then the lower the axial force on the first and second support members, and the greater the rate of axial displacement of the support members etc. for a given rate of radial movement by the mass elements.

It will further be understood that the rate of opening of the dump valve or other control valve will also be determined by other factors such as the geometry of the valve ports, the mass of the discrete mass element(s), and the effective (i.e., combined) slope or gradient of the opposed cam surfaces. In general the latter will be in the range from 10 to 60 degrees, preferably from 15 to 45 degrees, e.g., about 30 degrees (corresponding to 15 degrees for each of two symmetrical cam surfaces). It will of course be understood that where there are used cam surfaces with variable slope, then the above-mentioned slope angles can apply to the average slope of the cam surface along which the mass element travels. Where it is desired to increase substantially the travel or displacement of the movable valve element then there may of course be employed a plurality of actuator modules connected in series so that the displacements of the second support members of each of the actuator modules are added together. In order to damp out any tendency for the actuator to open and close the dump valve or other control valve repeatedly in quick succession, there is desirably provided an anti-hunting device, conveniently in the form of a frictional element, formed and arranged for resisting and delaying displacement of the second support member. Such a frictional element could, for example, be in the form of a frictional sealing element, e.g., a series of 'O' rings mounted for acting between the second support member and the support body therefor.

Various forms of dump valve or other control valve may be used in accordance with the present invention. Conveniently the dump valve or other control valve is in the form of a sleeve valve comprising a reciprocatingly displaceable sleeve provided with one or more ports which can be brought into and out of register with (a) corresponding port(s) in a sleeve mounting tube. Alternatively the valve may comprise a reciprocatingly displaceable sleeve having a valve face which might be either angled or orthogonal to the axis of motion, which is pressed against the mating seat in the housing. Motion of the sleeve away from the seat under action of the governor uncovers a port (series of ports) in the housing which allows the drive fluid to escape, bypassing the motor power station. Advantageously at least 3, conveniently from 4 to 8, for example 6, symmetrically angularly distributed ports are used.

It will also be appreciated that instead of the actuator acting directly on the dump valve or other control valve it may do so via a pilot valve. Again various forms of pilot valve arrangements could be used. In one convenient form of pilot valve controlled dump valve or other control valve there is provided a balancing pressure fluid chamber at the "closing pressure" side of the dump valve or other control valve, which chamber is in connection with the pressurized fluid supply to the bottom hole assembly (BHA) via a restricted fluid inlet whereby it is normally maintained at the same (high) pressure as the "opening pressure" side of the dump valve or other control valve. This balancing pressure fluid chamber is ventable (to the low pressure side of the BHA) via an exhaust passage controlled by a pilot valve actuatable by the speed governor device. Most conveniently the pilot valve is generally centrally disposed whereby the area of the pilot valve operating surfaces land hence required valve opening pressure may readily be made substantially smaller than would be the case with an annularly disposed valve.

We have also found that the relatively small dump valve or other control valve operating surface areas, and hence the relatively small opening pressures required, may be achieved by means of employing a centrally disposed dump valve or other control valve (rather than a sleeve-form dump valve or other control valve) to control an exhaust passage having a central inlet portion controlled by the dump valve or other control valve, and a plurality of radially outwardly extending outlet portions.

In further aspects the present invention provides: a down-hole motor, especially a turbine, provided with a speed governor of the present invention; and a down-hole apparatus comprising a drill string mounting a down-hole motor provided with a speed governor of the present invention and having a rotary cutting tool drivingly connected thereto.

The speed governor of the present invention can also be used as a means for clearing down-hole motive fluid filters used for screening out excessively large particulates from the motive fluid supply to a down-hole motor by providing a speed governor with a dump valve thereof disposed at the upstream side of the filter whereby opening of the dump valve, conveniently achieved by simply lifting off the drilling tool from the material being cut, provides a flow of motive fluid diverted away from the motor for washing away the particulates trapped by the filter, through the dump valve.

BRIEF DESCRIPTION OF THE DRAWINGS

Further preferred features and advantages of the invention will appear from the following detailed description given by way of example of some preferred embodiments illustrated with reference to the accompanying drawings in which:

FIG. 7 is a further view corresponding to FIG. 6 on a reduced scale illustrating the relationship of the governor to a turbine which it is being used to control the speed of;

DETAILED DESCRIPTION OF THE PREFERRED EMBODIMENTS

Figure 1:
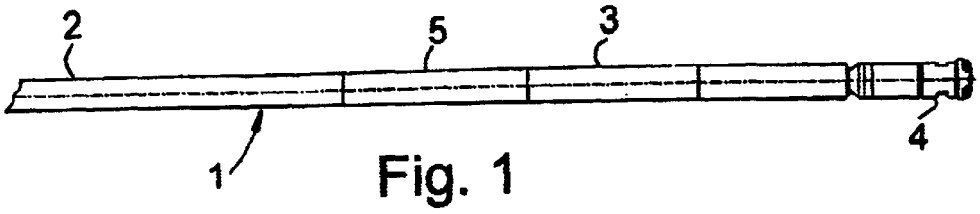
FIG. 1 is a schematic elevation of a drilling apparatus provided with a speed governor of the present invention.

FIG. 1 shows a drilling apparatus 1 comprising a drill string 2 supporting a down-hole turbine 3 used for driving a drilling bit 4 and provided with a speed governor 5. Conveniently the turbine is similar to that disclosed in our earlier patent publication no. WO 00/08293 (the contents of which are hereby incorporated herein), and especially as illustrated in the embodiments illustrated therein.

Figure 2:
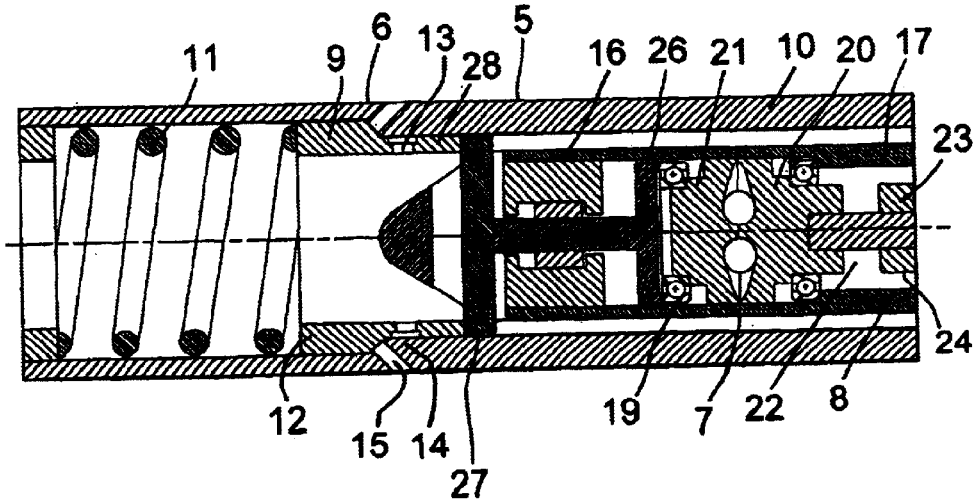
FIG. 2. Is a detail longitudinal section through a preferred embodiment of a speed governor of the present invention mounted in the upper end of a turbine, with the dump valve thereof in its closed position.
Figure 3:
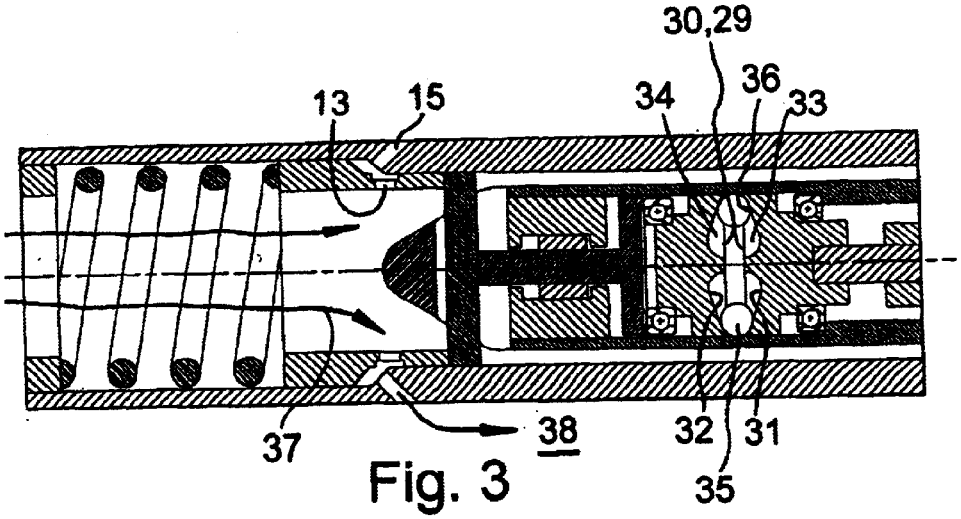
FIG. 3 is a view corresponding to that of FIG. 2 with the dump valve in its fully open position.

FIG. 2 shows a speed governor 5 comprising a dump valve 6 provided with an actuator 7 mounted at the upper end 8 of a down-hole turbine 3. In more detail the dump valve 6 comprises an inner sleeve member 9 mounted inside an outer casing extension 10 of the turbine 3 for sliding reciprocal movement. A pre-loaded helical spring 11 is mounted inside the outer casing extension 10 for acting against the upper end 12 of the sleeve 9 urging it into its closed position as shown in FIG. 2. The sleeve 9 has a series of ports 13 which are occluded by part 14 of the outer casing extension 10 in the closed position of the valve 6 shown in FIG. 2. When the sleeve 9 is displaced by the actuator 7 against the force of the spring 11, the ports 13 are brought into communication with a corresponding series of ports provided in the outer casing extension 10 as shown in FIG. 3.

The actuator 7 comprises a housing 16 connected 17 to the stator of the turbine (not shown in FIG. 3), and has rotatably mounted therein, via bearings 19, first and second support members in the form of circular plates 20, 21 respectively. The first plate 20 is drivingly connected 22 to the upper end 23 of the rotor 24 of the turbine. The upper, distal, end of the second plate 21 is in abutting engagement with a plunger 26 whose upper, distal, end 27 is in turn in abutting engagement with the lower end 28 of the sleeve.

The opposed faces 29, 30 of the first and second plates 20, 21 are provided with cam surfaces 31,32 which are provided in a series of part-circular section radially extending channels 33,34 in said faces 29,30. The channels 33,34 become progressively shallower in a radially outward direction, and hold therein discrete mass elements in the form of hard steel balls 35.

In use of the governor rotation of the plates 20,21 by the turbine rotor 24 results in the balls 35 being subjected to a centrifugal force which increases with increasing rotor speed.

This tends to drive the balls 35 radially outwardly into the outer shallower ends 36 of the channels 33,34 thereby tending to force the plates apart, once the biasing force of the preloaded spring 11 has been overcome. This results in upward axial displacement of the second plate 21, and in turn the plunger 26, which the pushes back the sleeve 9 to open the dump valve 6 as shown in FIG. 3, which results in motive fluid 37 being diverted away from the turbine 3 out into the borehole 38.

Figure 4:
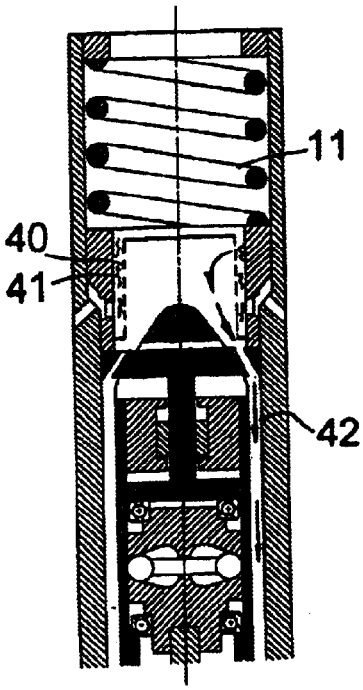
FIG. 4 is partly schematic longitudinal section illustrating use of the speed governor as a filter cleaning means.

FIG. 4 illustrates schematically use of the speed governor device of FIGS. and 3 to clear a filter 40 provided to screen out particulate matter 41 above a predetermined size to prevent passage thereof with the fluid supply 42 to the turbine 3. When the dump valve 6 is opened by the action of the speed governor—for example, in response to temporarily lifting off the drill bit 4 from the bottom of the bore-hole—a flow of fluid is exhausted through the aligned ports 13,15 in the valve sleeve 9 and outer casing extension 10 entraining the particulate matter held back by the filter 40 thereby substantially clearing the filter 40.

Figure 5:
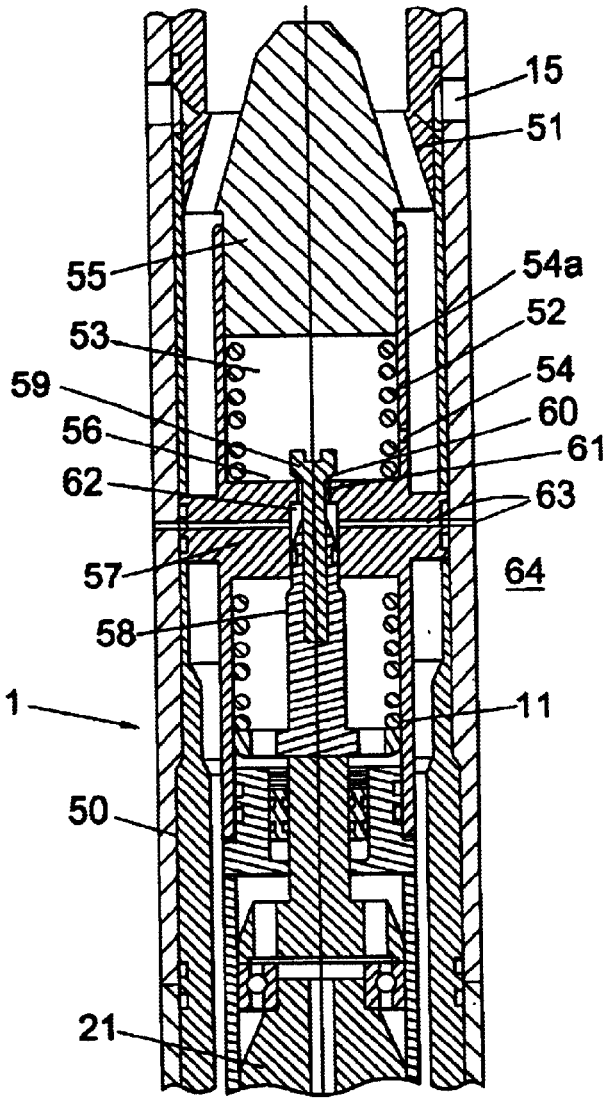
FIGS. 5 and 6 are views generally corresponding to FIG. 2 of two further embodiments.

FIG. 5 shows a modified embodiment of speed governor 50 having a sleeve type dump valve member 51 generally similar to that in FIGS. 2–3 but arranged to act in the opposite direction with a helical spring 52 biasing it upwardly. A balancing fluid pressure chamber 53 disposed below the valve member 51 (and within which the spring 52 is disposed) is supplied with pressurized fluid via a restricted aperture 54 in the cylinder wall 54*a* defining the chamber 53 within which a piston formed lower portion 55 of the valve member is slidably received.

At the bottom end 56 of the chamber 53 is provided a pilot valve unit 57. In more detail the pilot valve unit 57 comprises an axially extending valve member 58 having a chamfered closure portion 59 engagable with a valve seat 60 at a central inlet 61 of a vent passage 62 which has a plurality of angularly distributed radially outwardly extending outlets 63.

When the pilot valve unit 57 valve member 58 is displaced upwardly by the upward movement of the second plate 21 (see above description with reference to FIGS. 2–3), the pilot valve opens the vent passage inlet 61 and high pressure fluid is vented from the chamber 53 to the low pressure area 64 outside the bottom hole assembly 1.

The high pressure fluid acting on the upper side of the dump valve member 55 then forces down the dump valve member 55 thereby opening the dump valve and allowing venting of the main fluid supply via the valve ports 15 in the outer casing extension 10 similarly to FIG. 3. The continuing fluid supply through the restricted aperture 54 to the chamber 53 is not sufficient to maintain pressure therein when the pilot valve is open, but when the latter is closed, does allow pressure to build up in the chamber 53 again and thereby close up the dump valve again.

Figure 6:
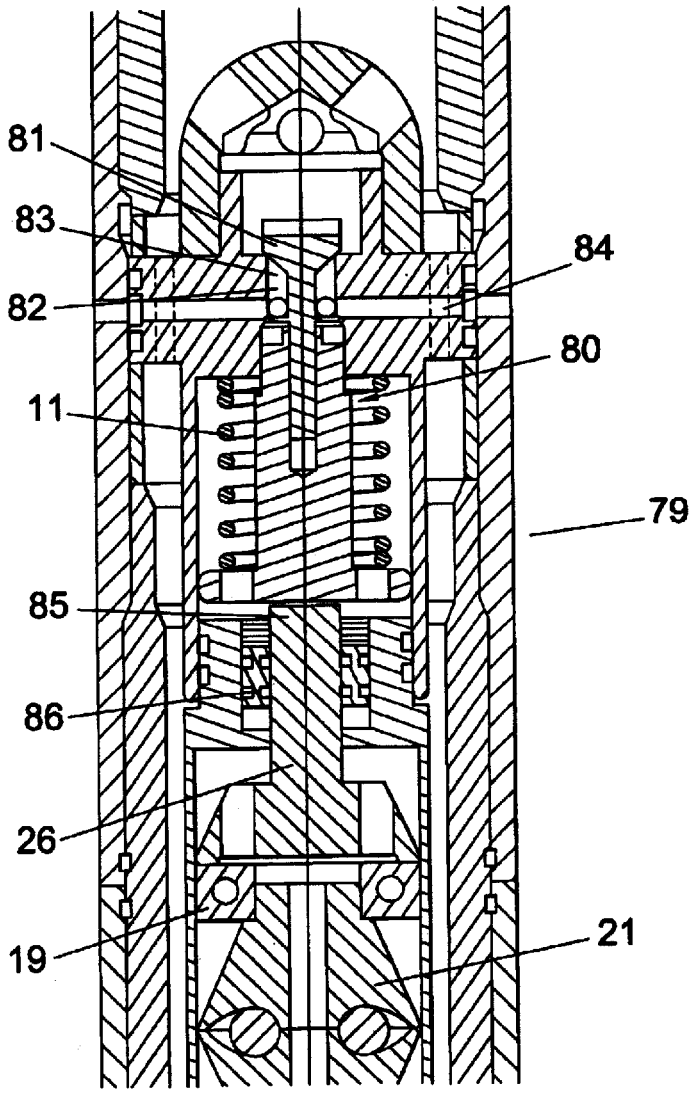
Figure 7:
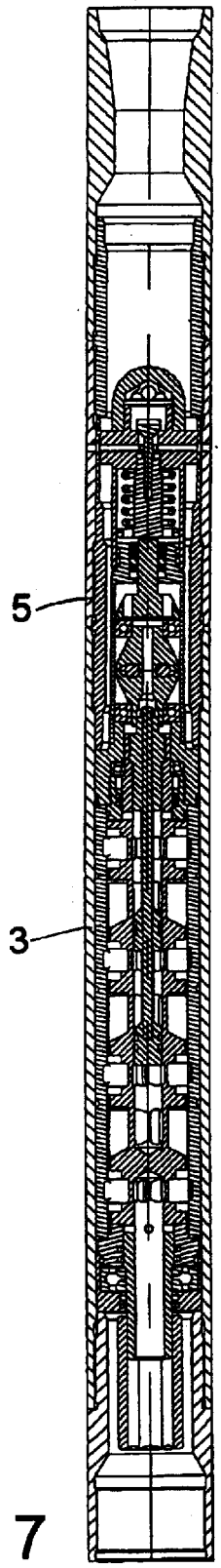

FIG. 6 shows another embodiment of speed governor 79 with a dump valve 80 having a centrally disposed dump valve member 81 controlling a vent passage 82 having a central axially extending inlet portion 83 and a plurality of angularly distributed radially outwardly extending outlet portions 84.

It will be appreciated that the dump valve 80 in this case works somewhat similarly to the pilot valve in the embodiment of FIG. 5 but with a substantially larger capacity vent passage. It will also be appreciated that this embodiment is of substantially simpler construction than that of FIG. 5 offering various advantages such as reduced manufacturing costs, increased reliability etc. It may also be seen in FIG. 6 that in this embodiment (similarly to those of FIGS. 2 to 5), the plunger 26 is non-rotating, being isolated from the rotating governor plates 20 (not shown) and 21 by an annular bearing 19. In these embodiments the governor mechanism (plates 20, 21, etc) is oil lubricated, the oil being contained below the upper end 85 of the plunger 26 by means of an annular seal 86.

Figure 8:
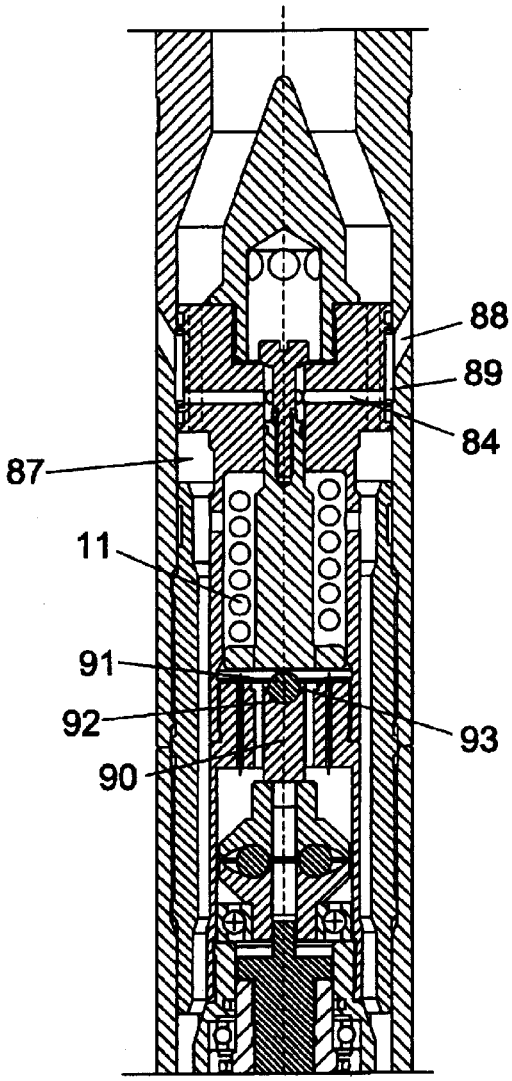
FIG. 8 is a view generally corresponding to FIG. 2 of a yet further embodiment.

FIG. 8 shows another embodiment of speed governor 87 generally similar to that of FIG. 6, with like parts corresponding to those in FIG. 6 being indicated by like reference numbers. In this case though, distal end exhaust ports 88 of the angularly distributed radially outwardly extending outlet portions 84 of vent passage 82 are angled upwardly (rearwards of the downhole direction). This has the advantages of avoiding discharge of fluid directly against the wall of the hole that has been 7 drilled, as a direct jet against the wall could cause collapse of the formation, as well as of assisting with the return of drill cuttings up the borehole.

In addition, the radially outwardly extending outlet portions 84 of vent passage 82 exit into an axially extending annular passage 89 immediately before the angled exhaust ports 88 thereby diffusing or reducing the pressure of the exhaust fluid, thereby further reducing the risk of any possible damage to the formation defining the borehole wall.

In this embodiment, unlike with the previous embodiments, the plunger 90 rotates together with the governor mechanism plates 20, 21 and is isolated from the non-rotating dump valve 80 by a single ball 91 seated in a recess 92 in the upper end face 93 of the plunger 90, acting as a rotary bearing between the plunger 90 and damp valve 80. In this case the governor mechanism (plates 20, 21 etc) is water lubricated, avoiding the need for providing lubricating oil and suitable seals to contain it. Thus it may be seen that in this respect, this embodiment is of somewhat simpler and easier to maintain, construction.

Figure 9A:
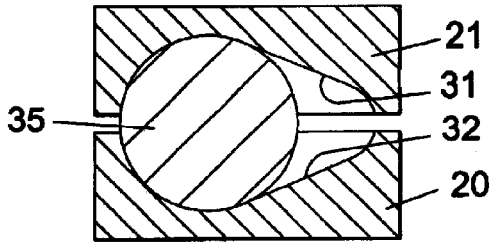
FIGS. 9A–C are detail views of various modified forms of cam surface of the governor.
Figure 9B:
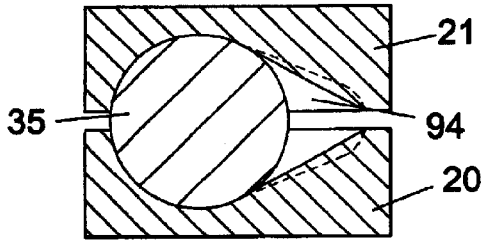
Figure 9C:
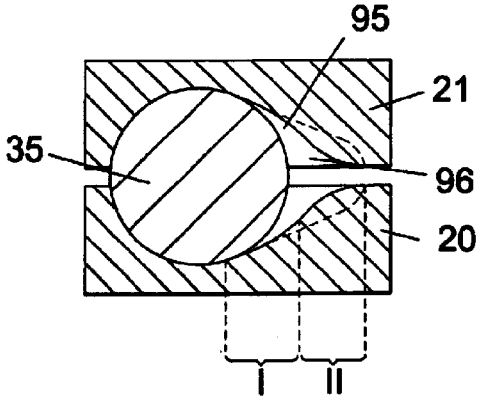
Figure 10:
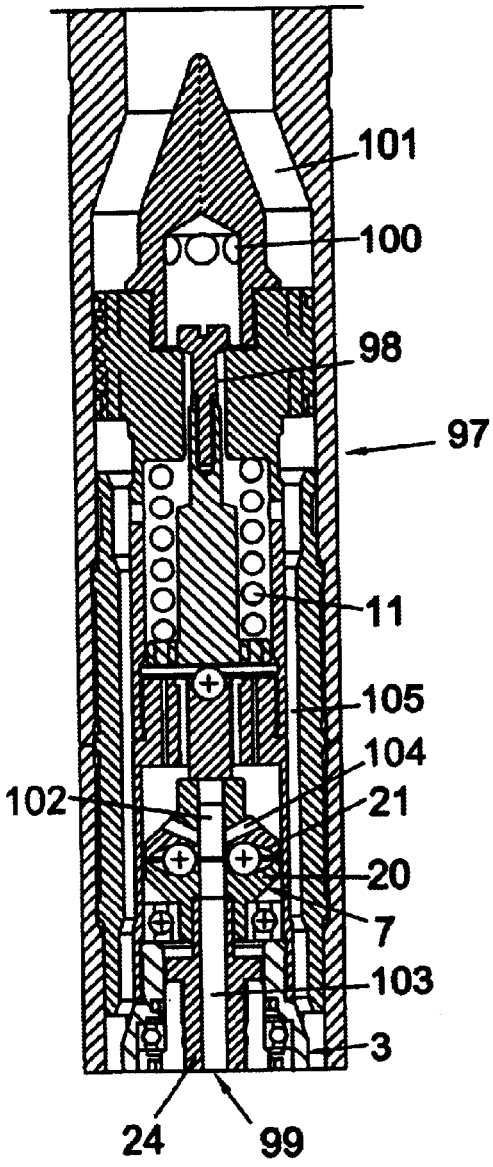
FIG. 10 is a longitudinal section view of another embodiment which uses an internal motive fluid by-pass valve.

FIG. 9A is a detail view on an enlarged scale of the cam surface 31, 32 used in the embodiments of FIGS. 2 to 8. FIGS. 9B and 9C show some modified alternative cam surface profiles comparing them with those used in FIG. 9A which are shown in dashed line. In the case of FIG. 9B, the cam surface profile 94 along which the ball 35 travels is rectilinear along its full length, and somewhat steeper than the cam surfaces 31, 32 of FIG. 9A. In the case of FIG. 9C, the cam surface profile has a first stage I radially inner convex portion 95 and a second stage II radially outer concave portion 96 providing a cam surface profile which is initially steeper before eventually becoming shallower than the cam surface profile of FIG. 9A. As discussed hereinbefore, such cam surface profile variants can be used to modify the relationship between the dump valve opening rate and the governor plate displacement rate, and in turn the rotor speed. By this means—especially with reference to FIG. 9C, it is possible to provide relatively complex changes in the relative displacement rates/albeit it is generally simpler to use springs with different spring rates for this purpose. Naturally a combination of changing spring rate and using modified cam surface profiles can be used to achieve particular desired dump valve opening characteristics. FIG. 10 shows a speed governor 97 somewhat similar to that of FIG. 8 but with a control valve in the form of a by-pass valve 98 controlling motive fluid flow to a by-pass passage 99. The by-pass passage extends from ports 100 in communication with a main motive fluid supply passage 101 down past the valve 98 to the actuator 7. The circular plates 20, 21 of the actuator 7 have a central axial bore 102 which connects to a central bore 103 extending through the rotor 24 of the downhole tool turbine 3. The second, upper, plate 21 has a plurality of angled radial inlet passages 104 leading into the central axial bore 102 therein for allowing entry of the motive fluid therein when the by-pass valve 98 is opened. Thus instead of dumping motive fluid to the outside when the control valve 98 opens as in the embodiment of FIG. 8, part of the motive fluid flow is directed away from an annular downhole tool turbine drive supply passage 105, into the central by-pass passage 99, so that there is no significant loss in fluid supply to the drilling bit 4 or other cutting tool for removing drill cuttings etc.

Figure 11:
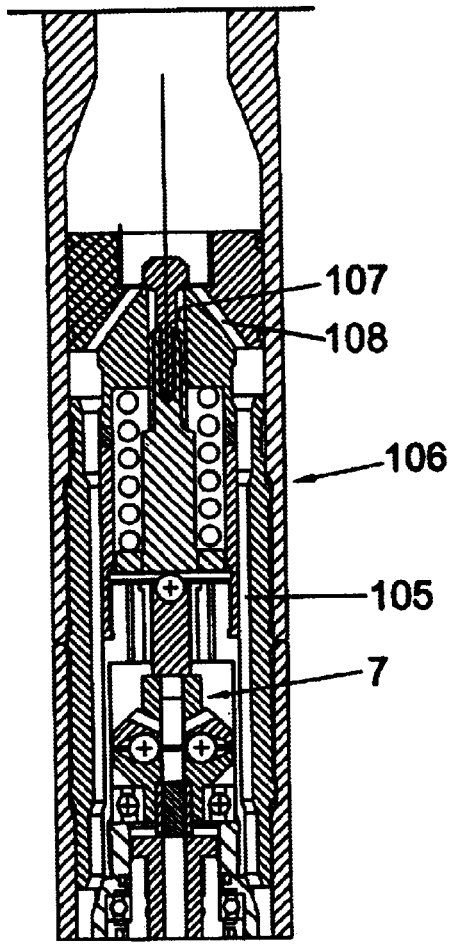
FIG. 11 is a longitudinal section view of another embodiment which uses an internal motive fluid flow restriction valve.

FIG. 11 shows another speed governor 106 with a control valve in the form of a flow restriction valve 107. In this case the control valve 107 is mounted so as to be in a normally open position in relation to the intake 108 to the annular downhole tool turbine drive fluid supply passage 105, and to restrict the intake 108 when it is displaced by the actuator 7. This form of control valve is particularly suitable for use when the motive fluid is gas since it avoids the loss of pressure which would occur with any dumping and thereby avoid the inevitable delay in building the gas pressure back-up again.

Figure 12:
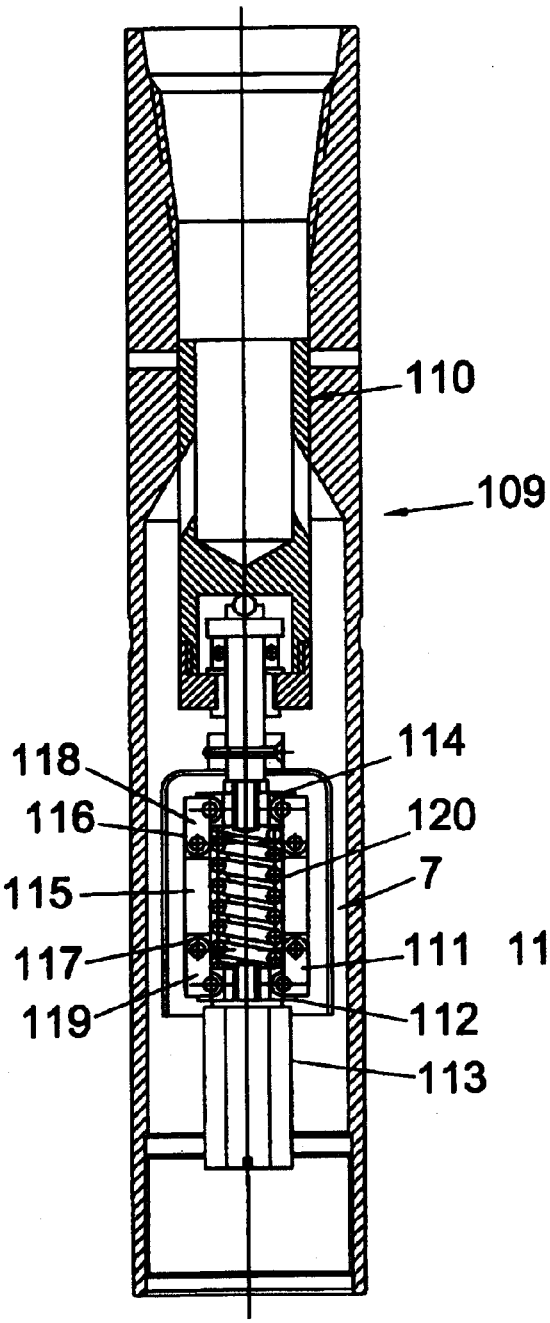
FIGS. 12 and 13 are schematic views showing normal flow and by-pass conditions of a mechanical linkage type speed governor actuator.
Figure 13:
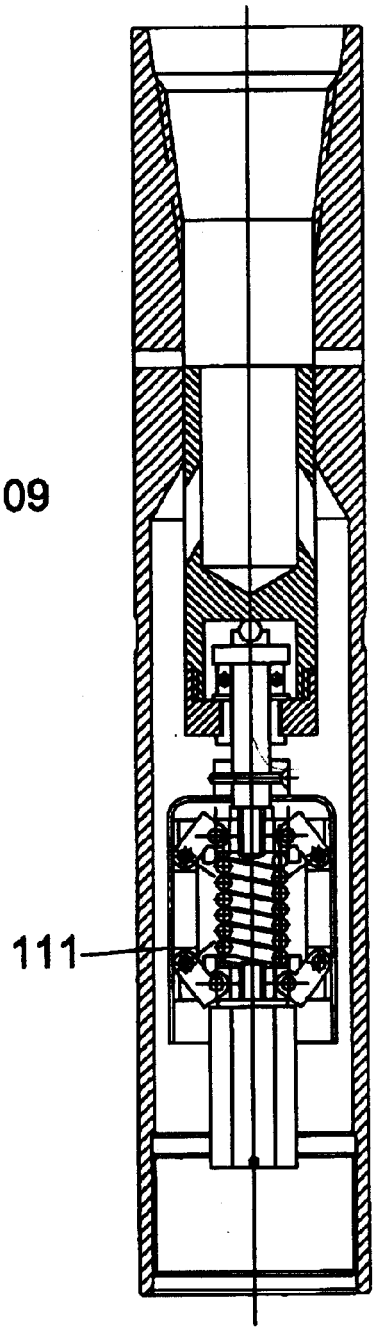

FIGS. 12 and 13 show yet another speed governor 109 wherein the dump valve 110 is operated by an alternative form of actuator 7. In more detail the actuator 7 comprises a multi-link cage assembly 111 having a lower end 112 drivingly coupled 113 to a rotor or other downhole tool rotating component (not shown here) and a movable upper end 114. Elongate first displacement link members 115 extend parallel to the longitudinal axis of the governor 109 and are connected at each end 116, 117 via second displacement link members 118, 119 to the cage assembly lower and upper members 112, 114. A resilient biasing device in the form of a helical spring 120 is disposed by said lower and upper members 112, 114 so as to urge them away from each other thereby pulling the first displacement members 115 in towards the central longitudinal axis of the governor 109.

As the turbine speed increases the first displacement link members 115. are subjected to increasing centrifugal forces tending to throw them radially outwards and thereby to pull the second displacement link members 118, 119 axially towards each other. When the pre-loading of the spring 120 is overcome, the upper member 114 of the cage assembly 111 is pulled down thereby displacing the dump valve 110 into its open position as shown in FIG. 13.

Figure 14:
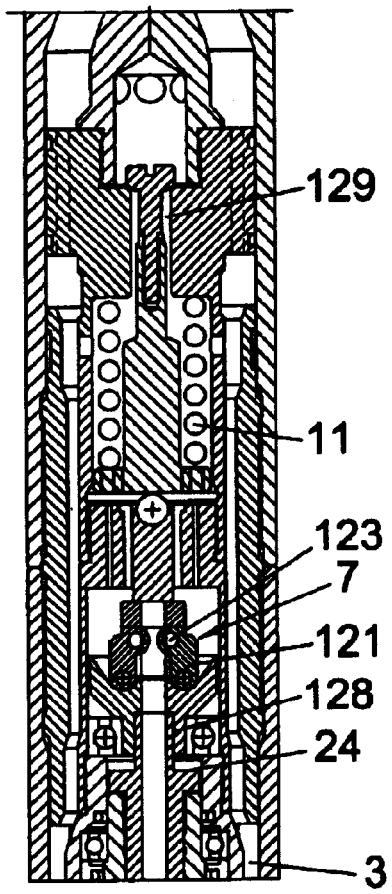
FIG. 14 is a longitudinal section view of a further embodiment similar to that of FIG. 10, with a modified speed governor actuator with internal by-pass valve in closed position.
Figure 15:
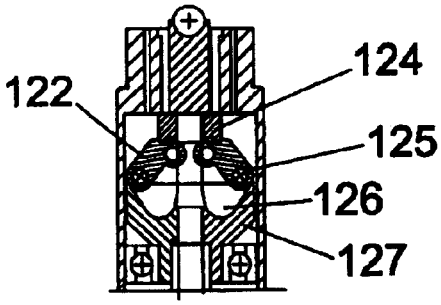
FIG. 15 is a detail view of the embodiment of FIG. 14 showing the actuator activated for opening the by-pass valve.

FIGS. 14 and 15 show yet a further speed governor with another modified form of actuator 7. In this case the actuator has elongate first displacement members 121 having upper ends 122 pivotally connected 123 to a central annular second displacement member 124, and lower ends 125 in camming inter-engagement with cam surfaces 126 provided on a base member 127 in opposed relation to the second displacement member 124.

The base member 127 is drivingly coupled 128 to the rotor 24 of the downhole tool turbine 3. As the rotor speed increases the lower ends 125 of the first displacement members 121 are subject to increasing centrifugal forces tending to thrown them radially outwards across the cam surfaces 126 thereby forcing the second axial displacement member 124 upwards. When the pre-loading on the resilient biasing device spring 11 is overcome, the activator adopts the position shown in FIG. 15 opening the control valve 129.

Figure 16:
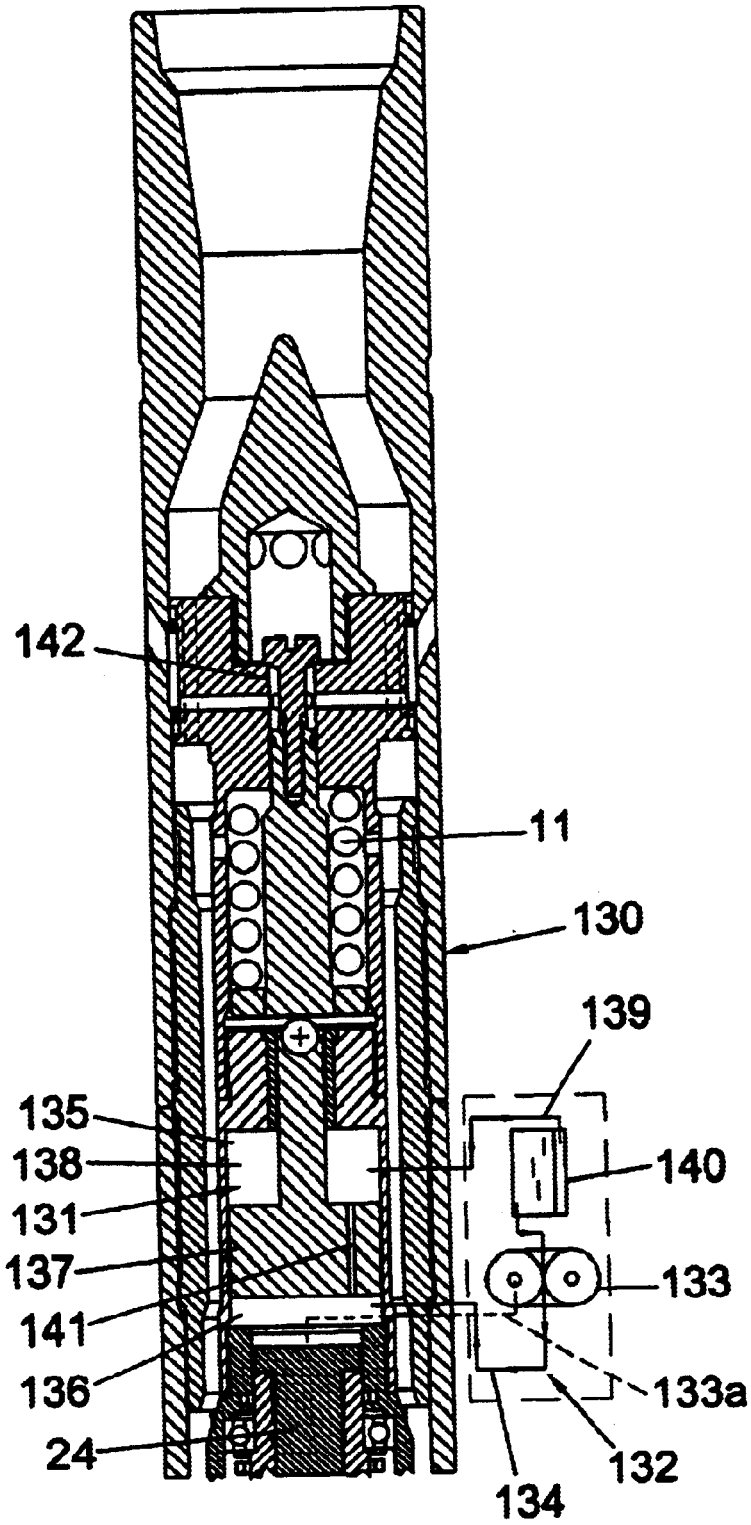
FIG. 16 is a partly schematic sectional view of a speed governor with an alternative form of hydraulic actuator suitable for use in one or more of the above embodiments.

FIG. 16 shows a still further speed governor 130 with a hydraulic form of activator 131. In more detail the hydraulic activator 131 comprises a hydraulic circuit 132 having a gear pump 133, connected 134 to a cylinder 135 at the high pressure side 136 of a piston 137 whose low pressure side 138 is connected 139 to the hydraulic fluid reservoir 140 of the circuit 132. The piston 137 has a small bore 141 extending between its high and low pressure sides 136, 138 for controlled leakage of hydraulic fluid therethrough. The gear pump 133 is mechanically driven 133*a* from the rotor 24. (It will be appreciated that the pump and other components are shown schematically for the purposes of clarity and would in practice be mounted internally of the speed governor 130.)

When the rotor speed exceeds a pre-determined threshold the hydraulic fluid pumping exceeds the maximum leakage rate through the small bore 141 and the piston 137 is forced upwards against the resilient biasing device spring 11 to open the dump valve 142.

Figure 17:
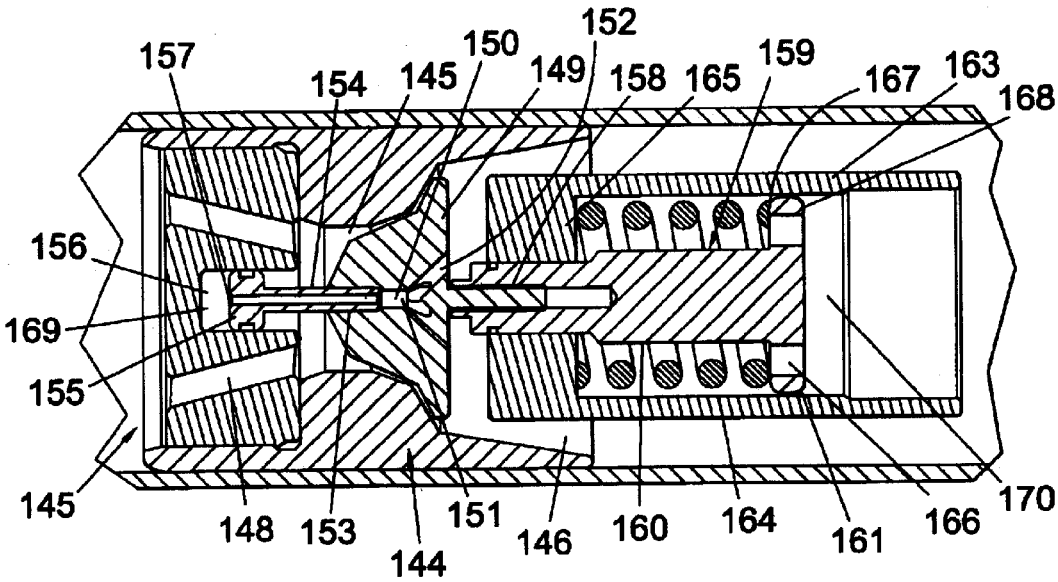
FIGS. 17 and 18 are detailed longitudinal section views of another form of internal motive fluid flow restriction valve in closed and open conditions thereof.

As described above with reference to FIG. 11, it is desirable in the case of fluid driven downhole tools which use gas as the motive fluid, to utilize a motive fluid flow control valve in the form of a flow restriction valve, in order to avoid the inevitable delays in building gas pressure back up to a desired operating value—which can typically be as long as 30 minutes. FIG. 17 shows a particularly advantageous modified form of speed governor in which the control valve is provided with a pressure compensating arrangement, in order to help ensure correct operation of the valve at different operating pressures, and especially at high operating pressures.

Figure 18:
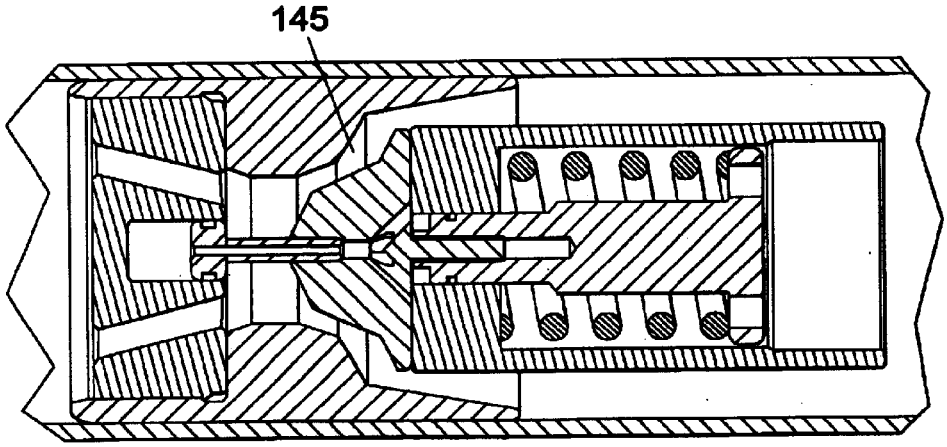

In more detail, FIGS 17 and 18 show a speed governor 143 generally similar to that of FIG. 11 and having a control valve in the form of a flow restriction valve 144. In this case the control valve 144 is mounted so as to be in a normally open position in relation to the intake 145 to the annular downhole tool turbine drive fluid supply passage 146, and to restrict the intake 145 when it is displaced by the actuator 7 (see FIG. 11 etc). It may be noted that in this case the intake 145 is in the form of an annular array 147 of intake passages 148. In this case, also, the valve 144 has a valve member 149 with a central passage 150 having a downstream end 151 in the form of a radially outwardly inclined array of ducts 152, and an upstream end 153 in which is mounted the shaft 154 of a small piston member 155 which is slidably mounted in a blind bore cylinder 156 disposed centrally of the annular array of intake passages 148. The piston member 155 and shaft 154 thereof have a centrally extending passage 157 in communication with the valve member central passage 150.

The valve member 149 also has a screwthreadedly connected 158 downstream end portion 159 in the form an axially extending shaft 160 with a distal head 161 slidably mounted inside a sleeve 163. A pre-loaded helical spring 164 is mounted inside the sleeve 163 for acting between the valve member head 161 and a restricted diameter upstream end portion 165 of the sleeve 163, so as to bias the valve member 149 into its normally open position as shown in FIG. 18. The valve member head 161 also has an annular array of apertures 166 for pressure balancing between the upstream and downstream sides 167, 168 thereof.

With the above described arrangement, it will be appreciated that the pressure inside the cylinder 156 at the upstream side 169 of the valve member 149 is balanced with that in the turbine drive fluid supply passage 146 at the downstream side 170 of the valve member 149, so that, whatever level the motive fluid pressure may rise to inside the drive of the downhole tool, the valve member 149 may still be reliably opened by the speed governor actuator 7 (see FIG. 11), without having to overcome any significant additional forces.

As noted above, the speed governors of the invention are suitable for use with a turbine as described in our earlier patent publication no. WO 00/08293. In more detail the latter disclosed a compact, high torque, turbine in the form of a combined impulse and drag turbine in which increased turbine drive output is obtained by means of increasing the turbine motive fluid energy transfer capacity in parallel rather than in series as with conventional downhole turbines, based on an impulse turbine with radial (as opposed to axial) fluid flow onto an annular turbine blade array on a rotor for rotation of the rotor.

More particularly, WO 00/08293 disclosed a turbine suitable for use in down-hole drilling and the like, and comprising a tubular casing enclosing a chamber having rotatably mounted therein a rotor comprising at least one turbine wheel means with an annular array of angularly distributed blade means oriented with drive fluid receiving face means thereof facing generally rearwardly of a forward direction of rotation of the rotor, and a generally axially extending inner drive fluid passage means disposed more or less radially inwardly of said rotor, said casing having generally axially extending outer drive fluid passage means, one of said inner and outer drive fluid passages being provided with outlet nozzle means formed and arranged for directing at least one jet of drive fluid onto said blade means drive fluid receiving faces as said blade means traverse said nozzle means for imparting rotary drive to said rotor, the other being provided with exhaust aperture means for exhausting drive fluid from the turbine. Preferably the turbine has a plurality, advantageously, a multiplicity, of said turbine wheel means disposed in an array of parallel turbine wheels extending longitudinally along the central rotational axis of the turbine with respective parallel drive fluid supply jets. Instead of, or in addition to providing a said inner or outer drive fluid passage for exhausting of drive fluid from the chamber, there could be provided exhaust apertures in axial end wall means of chamber, though such an arrangement would generally be less preferred due to the difficulties in manufacture and sealing. In yet another variant of the present invention, both the drive fluid supply and exhaust passage means could be provided in the casing (i.e., radially outwardly of the rotor) with drive fluid entering the chamber from the supply passage via nozzle means to impact the turbine blade means and drive them forward, and then exhausting from the chamber via outlet apertures angularly spaced from the nozzle means in a downstream direction, into the exhaust passages.

For the avoidance of doubt it should be noted that, in accordance with normal usage of the terminology in the industry, turbines, PDMs and other motors, may themselves also be referred to as downhole tools (and more particularly as fluid driven downhole tools). Thus references to downhole tools herein encompass not only drill bits, reamers etc but also turbines, motors etc, unless the context specifically requires otherwise.

A particular advantage of the claimed speed governors of the present invention is that they avoid the need for diverting fluid through the center of the downhole tool where generally only limited space is available thereby restricting flow reduction capacity, and/or where it would interfere with other requirements such as pressure balancing/compensation arrangements. Another advantage is that the reduced fluid flow through any downhole tool downstream of the fluid driven downhole tool reduces the hydraulic "pump-off" force that the downstream tool (e.g., bit) experiences as the fluid exits it, which force tends to keep the tool off of the drill face and reduces the rate of progress while operating said tool.

What is claimed is:

1. A speed governor suitable for use with a fluid driven downhole tool wherein said speed governor comprises an actuator operatively coupled to a motive fluid flow control valve, said actuator being formed and arranged so as to be activatable, directly or indirectly, in response to the running speed of the tool in use of said speed governor, said fluid flow control valve comprising a flow restriction valve formed and arranged for restricting motive fluid flow to said fluid driven downhole tool so that fluid flow through any downhole tool downstream of the fluid driven downhole tool is also restricted, wherein said actuator is provided with a resilient biasing device formed and arranged for, directly or indirectly, biasing said flow restriction valve away from a position for restricting motive fluid flow to said fluid drive, and wherein said actuator has at least one first displacement member, formed and arranged so as to be displaceable radially outwardly under the influence of centrifugal forces, directly or indirectly against the return force of said resilient biasing device.

2. A speed governor as claimed in claim 1 wherein said control valve comprises a pressure balanced control valve.

3. A speed governor as claimed in claim 2 wherein said control valve has a valve member, which valve member is provided with a pressure balancing passage providing fluid communication between opposed sides of said valve member.

4. A speed governor as claimed in claim 1 wherein said flow restriction valve comprises a throttle valve.

5. A speed governor as claimed in claim 1 wherein said flow restriction valve comprises a bypass valve formed and arranged for diverting at least part of the motive fluid flow away from the fluid inlet of said fluid driven downhole tool.

6. A speed governor as claimed in claim 1 wherein said flow restriction valve comprises a dump valve formed and arranged for diverting at least part of the motive fluid flow to the exterior of said fluid driven downhole tool.

7. A speed governor according to claim 1 wherein said at least one first displacement member is drivingly coupled to at least one second displacement member for axial displacement of said at least one second displacement member by said at least one first displacement member.

8. A speed governor according to claim 7 wherein said at least one first displacement member comprises a discrete mass element in camming inter-engagement with opposed cam surfaces provided on at least one of a respective said at least one second displacement member and a member opposed thereto.

9. A speed governor according claim 8 wherein said opposed cam surfaces have a combined slope angle in the range from 10 to 60 degrees in a radially inward direction.

10. A speed governor according to claim 8 wherein at least one of said cam surfaces has a cam surface portion with a substantially rectilinear cam surface profile.

11. A speed governor according to claim 8 wherein at least one of said cam surfaces includes at least one curved cam surface profile portion.

12. A speed governor according to claim 7 wherein said at least one first displacement member is pivotally linked to a respective said at least one second displacement member.

13. A speed governor according to claim 12 wherein said at least one first displacement member is formed and arranged for camming inter-engagement with a cam surface provided on a member opposed to said at least one second displacement member.

14. A speed governor according to claim 1 wherein said resilient biasing device has a predetermined pre-loading corresponding to a predetermined threshold downhole tool rotary component speed.

15. A speed governor system according to claim 14 wherein said resilient biasing device has a pre-loading corresponding to a threshold circumferential speed of said rotary component in the range from 30 to 55 meters/sec, for use with a turbine motor.

16. A speed governor according to claim 14 wherein said resilient biasing device has a spring rate for providing a progressive actuator displacement to provide a progressive opening of the control valve between fully closed and fully open position thereof over a rotor speed range which is from 5 to 20% of said threshold speed.

17. A speed governor according to claim 14 wherein said resilient biasing device has a variable spring rate for providing an actuator displacement rate which has a variable relation to rotary component speed increase.

18. A speed governor according to claim 1 wherein is provided an anti-hunting device.

19. A speed governor according to claim 18 wherein said anti-hunting device includes at least one of a viscous damping and frictional element, formed and arranged for resisting and delaying displacement of an actuator displacement member.

20. A speed governor suitable for use with a fluid driven downhole tool wherein said speed governor comprises an actuator operatively coupled to a motive fluid flow control valve, said actuator being formed and arranged so as to be activatable, directly or indirectly, in response to the running speed of the tool in use of said speed governor, said fluid flow control valve comprising a flow restriction valve formed and arranged for restricting motive fluid flow to said fluid driven downhole tool so that fluid flow through any downhole tool downstream of the fluid driven downhole tool is also restricted, wherein said control valve comprises a main control valve and a pilot control valve for facilitating opening of the main control valve.

21. A speed governor suitable for use with a fluid driven downhole tool wherein said speed governor comprises an actuator operatively coupled to a motive fluid flow control valve, said actuator being formed and arranged so as to be activatable, directly or indirectly, in response to the running speed of the tool in use of said speed governor, said fluid flow control valve comprising a flow restriction valve formed and arranged for restricting motive fluid flow to said fluid driven downhole tool so that fluid flow through any downhole tool downstream of the fluid driven downhole tool is also restricted, wherein the control valve comprises a sleeve valve comprising a reciprocatingly displaceable sleeve provided with one or more ports which can be brought into and out of register with a corresponding port in a sleeve mounting tube.

22. A speed governor suitable for use with a fluid driven downhole tool wherein said speed governor comprises an actuator operatively coupled to a motive fluid flow control valve, said actuator being formed and arranged so as to be activatable, directly or indirectly, in response to the running speed of the tool in use of said speed governor, said fluid flow control valve comprising a flow restriction valve formed and arranged for restricting motive fluid flow to said fluid driven downhole tool so that fluid flow through any downhole tool downstream of the fluid driven downhole tool is also restricted, wherein the control valve comprises a reciprocatingly displaceable sleeve having a valve face extending transversely to the axis of motion, for engagement with a valve seat for closing at least one port in the housing.

23. A speed governor suitable for use with a fluid driven downhole tool wherein said speed governor comprises an actuator operatively coupled to a motive fluid flow control valve, said actuator being formed and arranged so as to be activatable, directly or indirectly, in response to the running speed of the tool in use of said speed governor, said fluid flow control valve comprising a flow restriction valve formed and arranged for restricting motive fluid flow to said fluid driven downhole tool so that fluid flow through any downhole tool downstream of the fluid driven downhole tool is also restricted, wherein said actuator comprises a housing mounting a first support member and a second support member displaceable relative to said first support member, said first and second support members being provided with opposed cam surfaces and with resilient biasing means formed and arranged for biasing said support members with said cam surfaces towards each other, and at least one discrete mass element supported between said cam surfaces in engagement therewith, said cam surfaces converging towards each other in a radially outward direction so that forcing together of said first and second members by said biasing means urges said at least one mass element radially inwardly, whereby when said actuator is subjected to increasing rotational speed, in use thereof, said at least one mass element is subjected to increased centrifugal forces which tend to drive said first and second support members away from each other.

24. A downhole motor provided with a speed governor suitable for use with a fluid driven downhole tool wherein said speed governor comprises an actuator operatively coupled to a motive fluid flow control valve, said actuator being formed and arranged so as to be activatable, directly or indirectly, in response to the running speed of the tool in use of said speed governor, said fluid flow control valve comprising a flow restriction valve formed and arranged for restricting motive fluid flow to said fluid driven downhole tool so that fluid flow through any downhole tool downstream of the fluid driven downhole tool is also restricted, wherein the speed governor control valve is a dump valve connected to at least one vent passage having at least one exhaust port at an upstream side of a motor drive fluid supply passage filter for flushing out particulates trapped by said filter whereby, in use of said motor, said filter can be cleared by removing load from said motor so as to allow said motor to speed up sufficiently to cause said speed governor to open said dump valve, thereby to clear said filter.

25. A downhole motor according to claim 24 which is a turbine.

26. A downhole motor according to claim 24 which is a positive displacement motor.

27. A downhole motor according to claim 24 wherein the at least one vent passage is provided with a rearwardly angled exhaust port so as to be directed away from the downhole-direction in use of the speed governor.

28. A speed governor suitable for use in a fluid driven down-hole motor which has a rotor, for controlling motive fluid supply to said motor by means of a motive fluid dump valve, said governor comprising an actuator for said dump valve which actuator is formed and arranged for driven coupling to said motor rotor in use of the governor, said actuator comprising a housing mounting a first support member and a second support member displaceable relative to said first support member, said first and second support members being provided with opposed cam surfaces and with resilient biasing means formed and arranged for biasing said support members with said cam surfaces towards each other, and at least one discrete mass element supported between said cam surfaces in engagement therewith, said cam surfaces converging towards each other in a radially outward direction so that forcing together of said first and second members by said biasing means urges said at least one mass element radially inwardly, whereby when said actuator is subjected to increasing rotational speed, in use thereof, said at least one mass element is subjected to increased centrifugal forces which tend to drive said first and second support members away from each other, said second support member being coupled to said dump valve for opening thereof when said second support member is driven away from said first support member by said mass element with increasing rotational speed of the motor above a predetermined speed limit.

29. A downhole motor provided with a speed governor according to claim 28.

* * * * *